US008508200B2

(12) United States Patent
Yamamoto et al.

(10) Patent No.: US 8,508,200 B2
(45) Date of Patent: Aug. 13, 2013

(54) POWER SUPPLY CIRCUIT USING AMPLIFIERS AND CURRENT VOLTAGE CONVERTER FOR IMPROVING RIPPLE REMOVAL RATE AND DIFFERENTIAL BALANCE

(75) Inventors: Ryuji Yamamoto, Yao (JP); Yuichi Inakawa, Ota (JP)

(73) Assignees: Semiconductor Components Industries, LLC, Phoenix, AZ (US); Sanyo Semiconductor Co., Ltd., Ora-Gun, Gunma (JP)

( * ) Notice: Subject to any disclaimer, the term of this patent is extended or adjusted under 35 U.S.C. 154(b) by 543 days.

(21) Appl. No.: 12/778,626

(22) Filed: May 12, 2010

(65) Prior Publication Data

US 2010/0289464 A1 Nov. 18, 2010

(30) Foreign Application Priority Data

May 14, 2009 (JP) ..... 2009-117707

(51) Int. Cl.
*G05F 1/00* (2006.01)
*G05F 3/16* (2006.01)
*G05F 3/20* (2006.01)

(52) U.S. Cl.
USPC ..... 323/280; 323/316

(58) Field of Classification Search
USPC ..... 323/280, 315, 316; 327/52, 53, 327/54; 330/250, 252, 253, 257, 260, 263, 330/310
See application file for complete search history.

(56) References Cited

U.S. PATENT DOCUMENTS

| | | | | |
|---|---|---|---|---|
| 4,713,626 | A * | 12/1987 | Susak et al. | 330/253 |
| 5,900,781 | A * | 5/1999 | Igarashi et al. | 330/254 |
| 5,994,959 | A * | 11/1999 | Ainsworth | 330/252 |
| 6,906,589 | B2 * | 6/2005 | Ikeda et al. | 330/261 |
| 2009/0167427 | A1 * | 7/2009 | Kawamoto et al. | 327/563 |
| 2009/0273323 | A1 * | 11/2009 | Kimura | 323/265 |

FOREIGN PATENT DOCUMENTS

JP 2007-188533 7/2007

OTHER PUBLICATIONS esp@cenet patent abstract for Japanese Publication No. 2007188533, Publication date Jul. 26, 2007 (1 page).

* cited by examiner

*Primary Examiner* — Adolf Berhane
*Assistant Examiner* — Emily Pham
(74) *Attorney, Agent, or Firm* — Osha • Liang LLP

(57) ABSTRACT

A power supply circuit comprises a power transistor, a differential amplifier, an I/V converter circuit, and an inverting amplifier, wherein the differential amplifier comprises a first current path in which a first resistor element, a first current mirror transistor, and a first control transistor are connected in series, and a second current path in which a second resistor element, a second current mirror transistor, and a second control transistor are connected in series, and the power supply circuit comprises a phase compensating capacitor element connected in parallel with the inverting amplifier, and a ripple removal rate improving capacitor element which is connected between ground and a connection point between the first resistor element and the first current mirror transistor, or between the ground and a connection point between the second resistor element and the second current mirror transistor.

2 Claims, 3 Drawing Sheets

POWER SUPPLY CIRCUIT USING AMPLIFIERS AND CURRENT VOLTAGE CONVERTER FOR IMPROVING RIPPLE REMOVAL RATE AND DIFFERENTIAL BALANCE

CROSS-REFERENCE TO RELATED APPLICATION(S)

The priority application Number JP 2009-117707 filed on May 14, 2009 upon which this application is based is hereby incorporated by reference.

BACKGROUND

1. Technical Field

The present invention relates to a power supply circuit, and in particular, to a power supply circuit having an inverting amplifier.

2. Related Art

Currently, power supply circuits are used in various electronic devices. In a power supply circuit, when a feedback is executed using a feedback-type amplifier circuit such as an inverting amplifier, a shift in phase causes oscillation, and, in some cases, an accurate output waveform cannot be obtained. In order to prevent this, phase compensation must be executed for inhibiting the shift of the phase within a certain limit range in the power supply circuit.

For example, JP 2007-188533 A discloses a voltage regulator which generates a predetermined constant voltage based on a reference voltage which is set in advance and which outputs the generated voltage from an output terminal, comprising a detecting circuit section which detects a voltage which is output from the output terminal, generates a voltage corresponding to the detected output voltage, and outputs a generated voltage, and a differential amplifier section which compares voltages between a voltage which is output from the detecting circuit section and a reference voltage, and outputs a voltage indicating a comparison result. In addition, the voltage regulator comprises a phase compensating circuit section which advances a phase of the voltage which is output from the detecting circuit section and outputs to the differential amplifier section as a feedback voltage, to execute phase compensation, an output circuit section having a driver transistor which outputs a current corresponding to a voltage which is output from the differential amplifier section and which outputs a predetermined constant voltage via an output terminal, and a phase compensation control circuit section which controls a frequency in which the phase compensating circuit section executes the phase compensation, according to the current which is output from the output circuit section.

In a power supply circuit which executes feedback of a feedback voltage using a feedback-type amplifier circuit such as an inverting amplifier, phase compensation can be executed using a phase compensating capacitor. However, when the power supply circuit has the differential amplifier which compares the reference voltage and the feedback voltage, if a capacitance value of the phase compensating capacitor is adjusted, a shift in the differential balance of the differential amplifier with respect to the change of the input power supply voltage becomes significant, and there is a possibility that the ripple removing rate may be degraded at a certain frequency region.

SUMMARY

According to one aspect of the present invention, there is provided a power supply circuit comprising a power transistor which is placed between an input power supply and an output terminal, a differential amplifier which outputs, as a current difference, a difference between a feedback voltage obtained by dividing an output voltage, which is a voltage on the output terminal, and a reference voltage, an I/V converter circuit which converts the current difference into a voltage difference, and an amplifier which amplifies the voltage difference and supplies the amplified voltage difference to a control terminal of the power transistor as a signal for controlling an ON resistance of the power transistor, wherein the differential amplifier comprises a first current path in which a first current mirror transistor and a first control transistor are connected in series, wherein the first current mirror transistor is connected to the input power supply, a predetermined current mirror current flows in the first current mirror transistor via a first resistor element, and the reference voltage is input to the first control transistor, a second current path in which a second current mirror transistor and a second control transistor are connected in series, wherein the second current mirror transistor is connected to the input power supply, a predetermined current mirror current flows in the second current mirror transistor via a second resistor element, and the feedback voltage is input to the second control transistor, and a constant current source section which sets a sum of a current flowing in the first current path and a current flowing in the second current path to be a predetermined constant current, and the power supply circuit comprises a first capacitor element which is connected in parallel with the amplifier, and a second capacitor element which is connected between ground and a connection point between the first resistor element and the first current mirror transistor or between the ground and a connection point between the second resistor element and the second current mirror transistor.

BRIEF DESCRIPTION OF THE DRAWINGS

A preferred embodiment of the present invention will be described in detail based on the following drawings, wherein.

DETAILED DESCRIPTION

Figure 1:
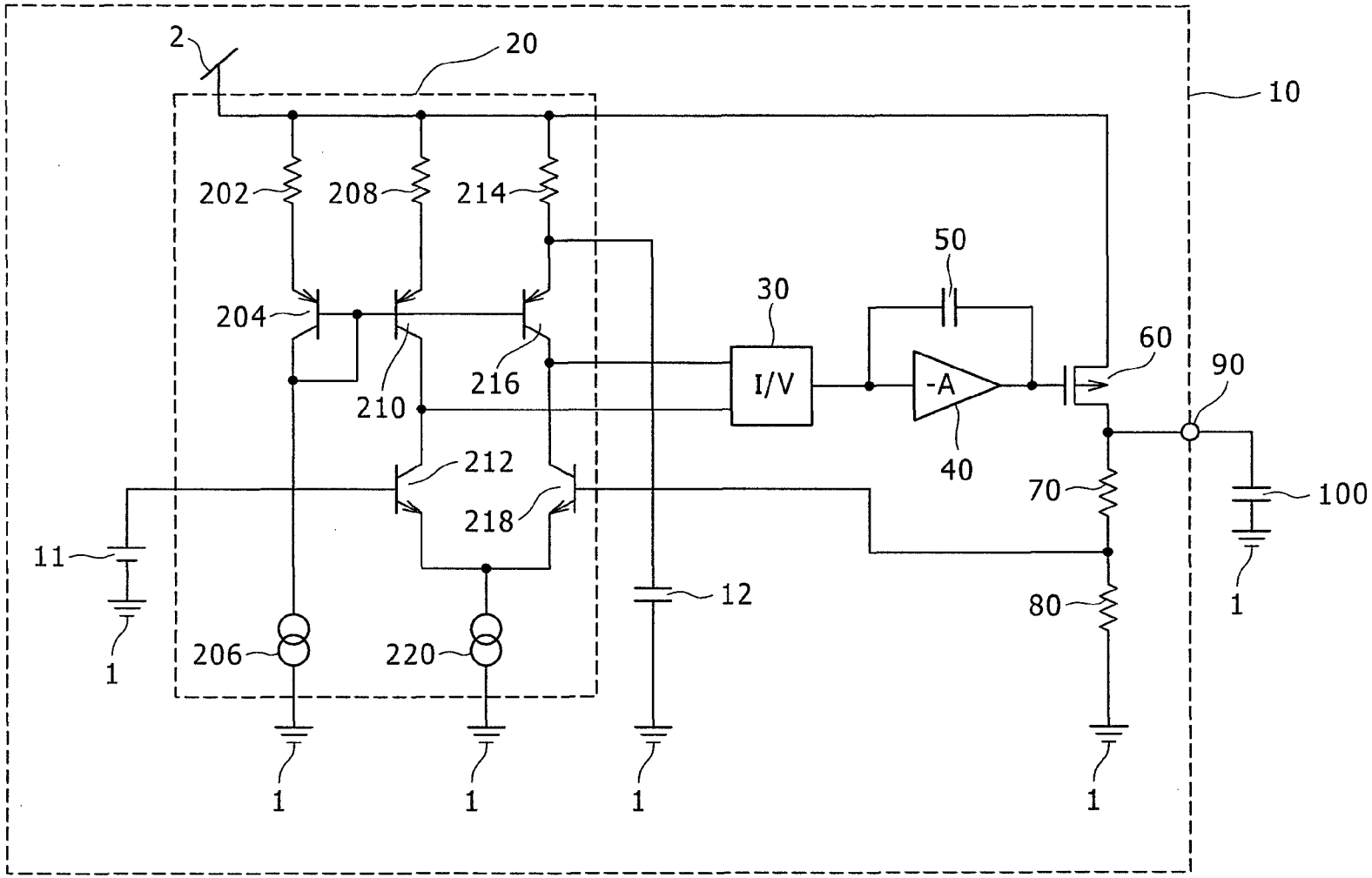
FIG. 1 is a diagram showing a power supply circuit in a preferred embodiment of the present invention.

A preferred embodiment of the present invention will now be described in detail with reference to the attached drawings. In the following description, a MOS transistor is exemplified as a power transistor, but alternatively, a bipolar transistor may be used as the power transistor.

In the following description, the same reference numerals are assigned to the same elements in all drawings, and the explanation will not be repeated. In addition, in the description, the reference numerals which are already mentioned will be used, as necessary.

FIG. 1 is a diagram showing a power supply circuit 10. The power supply circuit 10 comprises a reference power supply 11, a differential amplifier 20, an I/V converter circuit 30, an inverting amplifier 40, a power transistor 60, a first resistor element 70, a second resistor element 80, a phase compensating capacitor element 50, a ripple removal rate improving capacitor element 12, and an output terminal 90. An external capacitor 100 is connected to the output terminal 90 of the power supply circuit 10.

The differential amplifier 20 has a function to output, as a current difference, a difference between a feedback voltage which is obtained by dividing an output voltage which is a voltage on the output terminal 90 and a reference voltage which is output by the reference power supply 11. The differential amplifier 20 comprises resistor elements 202, 208, and 214, constant current source sections 206 and 220, and transistors 204, 210, 212, 216, and 218.

The resistor element 202 is a circuit element in which one terminal is connected to an input power supply 2, and the other terminal is connected to an emitter terminal of the transistor 204. The transistor 204 is a pnp bipolar transistor in which the emitter terminal is connected to the other terminal of the resistor element 202, a base terminal is connected to base terminals of the transistors 210 and 216 and also to a collector terminal of the transistor 204, and a collector terminal is connected to one terminal of the constant current source section 206 and the base terminal of the transistor 204. The constant current source section 206 is a constant current source in which the one terminal is connected to the collector terminal of the transistor 204 and the base terminal of the transistor 204, and the other terminal is connected to a ground 1 and is grounded, and which supplies a current of a predetermined current value.

The resistor element 208 is a circuit element in which one terminal is connected to the input power supply 2 and the other terminal is connected to an emitter terminal of the transistor 210. The transistor 210 is a pnp bipolar transistor in which the emitter terminal is connected to the other terminal of the resistor element 208, a base terminal is connected to base terminals of the transistors 204 and 216 and also to the collector terminal of the transistor 204, and a collector terminal is connected to a collector terminal of the transistor 212 and a first-side connection terminal of the I/V converter circuit 30. The transistor 212 is an npn bipolar transistor in which the collector terminal is connected to the collector terminal of the transistor 210 and the first-side connection terminal of the I/V converter circuit 30, a base terminal is connected to the reference power supply 11, and an emitter terminal is connected to one terminal of the constant current source section 220 and an emitter terminal of the transistor 218. The constant current source section 220 has the one terminal connected to the emitter terminal of the transistor 212, and the one terminal connected to the emitter terminal of the transistor 218, and the other terminal connected to the ground 1 and grounded. In addition, the constant current source section 220 is a current source which supplies a current such that a current which is a sum of a current flowing in the transistor 212 and a current flowing in the transistor 218 is set to a predetermined constant current.

The resistor element 214 is a circuit element in which one terminal is connected to the input power supply 2, and the other terminal is connected to the emitter terminal of the transistor 216 and a positive electrode terminal of the ripple removal rate improving capacitor element 12. The transistor 216 is a pnp bipolar transistor in which the emitter terminal is connected to the other terminal of the resistor element 214 and the positive electrode terminal of the ripple removal rate improving capacitor element 12, a base terminal is connected to the base terminals of the transistors 204 and 210 and to the collector terminal of the transistor 204, and a collector terminal is connected to the collector terminal of the transistor 218 and a second-side connection terminal of the I/V converter circuit 30. The transistor 218 is an npn bipolar transistor in which the collector terminal is connected to the collector terminal of the transistor 216 and the second-side connection terminal of the I/V converter circuit 30, a base terminal is connected to a connection point between the first resistor element 70 and the second resistor element 80, and an emitter terminal is connected to the emitter terminal of the transistor 212 and one terminal of the constant current source section 220.

The reference power supply 11 has one terminal connected to the base terminal of the transistor 212 and the other terminal connected to the ground 1 and grounded. The reference power supply 11 inputs a reference voltage value, for executing a comparison at the differential amplifier 20, to the base terminal of the transistor 212.

The I/V converter circuit 30 has a function to convert the current difference, when the feedback voltage to be described later is higher than the reference voltage which is input from the reference power supply 11, into a negative-side voltage difference, and to convert a current difference when the feedback voltage is lower than the reference voltage into a positive-side current difference. In the I/V converter circuit 30, the first-side connection terminal is connected to the connection point between the collector terminal of the transistor 210 and the collector terminal of the transistor 212, the second-side connection terminal is connected to the connection point between the collector terminal of the transistor 216 and the collector terminal of the transistor 218, and an output terminal is connected to the input terminal of the inverting amplifier 40 and a positive electrode side terminal of the phase compensating capacitor element 50.

The inverting amplifier 40 is a circuit which amplifies a voltage which is input on an input terminal, inverts the polarity, and outputs the resulting voltage. In the inverting amplifier 40, the input terminal is connected to the output terminal of the I/V converter circuit 30 and the positive electrode side terminal of the phase compensating capacitor element 50, and an output terminal is connected to a negative electrode side terminal of the phase compensating capacitor element 50 and a gate terminal (control terminal) of the power transistor 60.

The phase compensating capacitor element 50 is a capacitor element for correcting a phase which is shifted when the feedback voltage is fed back in the power supply circuit 10. The phase compensating capacitor element 50 is connected in parallel with the inverting amplifier 40. More specifically, in the phase compensating capacitor element 50, the positive electrode side terminal is connected to the input terminal of the inverting amplifier 40 and the output terminal of the I/V converter circuit 30, and the negative electrode side terminal is connected to the output terminal of the inverting amplifier 40 and the gate terminal of the power transistor 60.

The power transistor 60 is a p-channel MOS transistor which outputs a stable output voltage to the output terminal 90 based on a voltage which is output from the inverting amplifier 40. In the power transistor 60, a source terminal is connected to the input power supply 2, the gate terminal (control terminal) is connected to the negative electrode side terminal of the phase compensating capacitor element 50 and the output terminal of the inverting amplifier 40, and a drain terminal is connected to the one terminal of the first resistor element 70 and the output terminal 90.

The first resistor element 70 and the second resistor element 80 are connected in series, and have a function to divide the output voltage, which is a voltage on the output terminal 90, to obtain the feedback voltage. In the first resistor element 70, one terminal is connected to the drain terminal of the power transistor 60 and the output terminal 90, and the other terminal is connected to the one terminal of the second resistor element 80 and the base terminal of the transistor 218. In the second resistor element 80, the one terminal is connected to the other terminal of the first resistor element 70 and the base terminal of the transistor 218, and the other terminal is connected to the ground 1 and grounded. With such a configuration, the feedback voltage which is obtained by voltage division by the first resistor element 70 and the second resistor element 80 is input to the base terminal of the transistor 218. In FIG. 1, the first resistor element 70 and the second resistor element 80 are provided as a part of the element forming the power supply circuit 10, but may alternatively be provided as an external component of the power supply circuit 10.

The ripple removal rate improving capacitor element 12 is a capacitor element for improving the ripple removal rate of the power supply circuit 10. In the ripple removal rate improving capacitor element 12, one terminal is connected to the connection point between the resistor element 214 and the transistor 216, and the other terminal is connected to the ground 1 and grounded.

Next, an operation of the power supply circuit 10 having the above-described structure will be described with reference to FIG. 1. The power supply circuit 10 is a circuit for outputting a stable output voltage to the output terminal 90. More specifically, the feedback voltage which is obtained by dividing the output voltage which is the voltage on the output terminal 90 by the first resistor element 70 and the second resistor element 80 is input to the base terminal of the transistor 218. Moreover, the reference voltage which is output by the reference power supply 11 is input to the base terminal of the transistor 212.

In the differential amplifier 20, as described above, the base terminals of the transistors 204 and 210 are connected to each other, and the base terminal and the collector terminal of the transistor 204 are connected to each other, so that a first current mirror circuit is formed. Therefore, a current of a current value which is equal to that of a current flowing in the transistor 204 (that is, a current mirror current) flows in the transistor 210 which is a part of the first current mirror circuit. A first current path through which the above-described current flows is formed by the resistor element 208, the transistor 210, and the transistor 21 which are connected in series.

In addition, in the differential amplifier 20, as described above, the base terminals of the transistors 204 and 216 are connected to each other, and the base terminal and the collector terminal of the transistor 204 are connected to each other, so that a second current mirror circuit is formed. Therefore, a current of a current value which is equal to that of a current flowing in the transistor 204 (that is, a current mirror current) flows in the transistor 216 which is a part of the second current mirror circuit. Thus, currents of the same current value flow in the transistor 210 which is a part of the first current mirror circuit and in the transistor 216 which is a part of the second current mirror circuit. A second current path through which the above-described current flows is formed by the resistor element 214, the transistor 216, and the transistor 218 which are connected in series.

For example, when the reference voltage is higher than the feedback voltage (that is, when the output voltage is higher than a desired voltage), the current value of the current flowing in the transistor 218 is higher than the current value of the current flowing in the transistor 212, and thus a difference in the current value, that is, a current as a current difference, flows from the collector terminal of the transistor 210 to the first-side connection terminal of the I/V converter circuit 30, and is supplied from the second-side connection terminal to the collector terminal of the transistor 216. In this process, as the output of the I/V converter circuit 30, a voltage difference corresponding to the current difference is output in a negative polarity. Then, the negative-side voltage difference is amplified by the inverting amplifier 40, a positive-side voltage in which the polarity is inverted is output, and the output voltage is input to the gate terminal of the power transistor 60, resulting in a lower current flowing in the power transistor 60. With such a configuration, the voltage of the output terminal 90 is reduced and a stable desired output voltage is achieved.

On the other hand, for example, when the feedback voltage is lower than the reference voltage (that is, when the output voltage is lower than a desired voltage), the current value of the current flowing in the transistor 212 is higher than that of the current flowing in the transistor 218, and thus a difference in current value, that is, a current as a current difference, flows from the collector terminal of the transistor 216 to the second-side connection terminal of the I/V converter circuit 30 and from the first-side connection terminal to the collector terminal of the transistor 210. In this process, as the output of the I/V converter circuit 30, a voltage difference corresponding to the current difference is output with a positive polarity. Then, the positive-side voltage difference is amplified by the inverting amplifier 40, a negative-side voltage in which the polarity is inverted is output, and the output voltage is input to the gate terminal of the power transistor 60, resulting in a higher current flowing in the power transistor 60. With this process, the voltage of the output terminal 90 is increased and a stable desired output voltage is achieved.

As described above, in the power supply circuit 10, the shift in the phase is compensated by providing the phase compensating capacitor element 50 in parallel with the inverting amplifier 40. An AC gain when the output side of the I/V converter circuit 30 is viewed from the side of the input power supply 2 will now be described. An AC gain through a path of the resistor element 208, the transistor 210, and the first-side connection terminal of the I/V converter circuit 30 is referred to as A1 and an AC gain through a path of the resistor element 214, the transistor 216, and the second-side connection terminal of the I/V converter circuit 30 is referred to as A2. When A1<A2 due to reasons such as variation in the resistance values of the resistor elements 208 and 214, because the phase compensating capacitor element 50 is provided, the variation in the AC gain becomes significant in a high frequency region such as, for example, a frequency region of around 100 kHz. With the power supply circuit 10, however, in the path of A2 which is the higher AC gain, because the ripple removal rate improving capacitor element 12 is placed between the ground 1 and the connection point between the other terminal of the resistor element 214 and the emitter terminal of the transistor 216, of the two AC gains, A2 is attenuated. With this process, the difference between A1 and A2 can be reduced (that is, the shift in the differential balance is resolved), and the ripple removal rate can be improved. The difference between A1 and A2 can be set to substantially 0 by adjusting the capacitance value of the ripple removal rate improving capacitor element 12.

Figure 2:
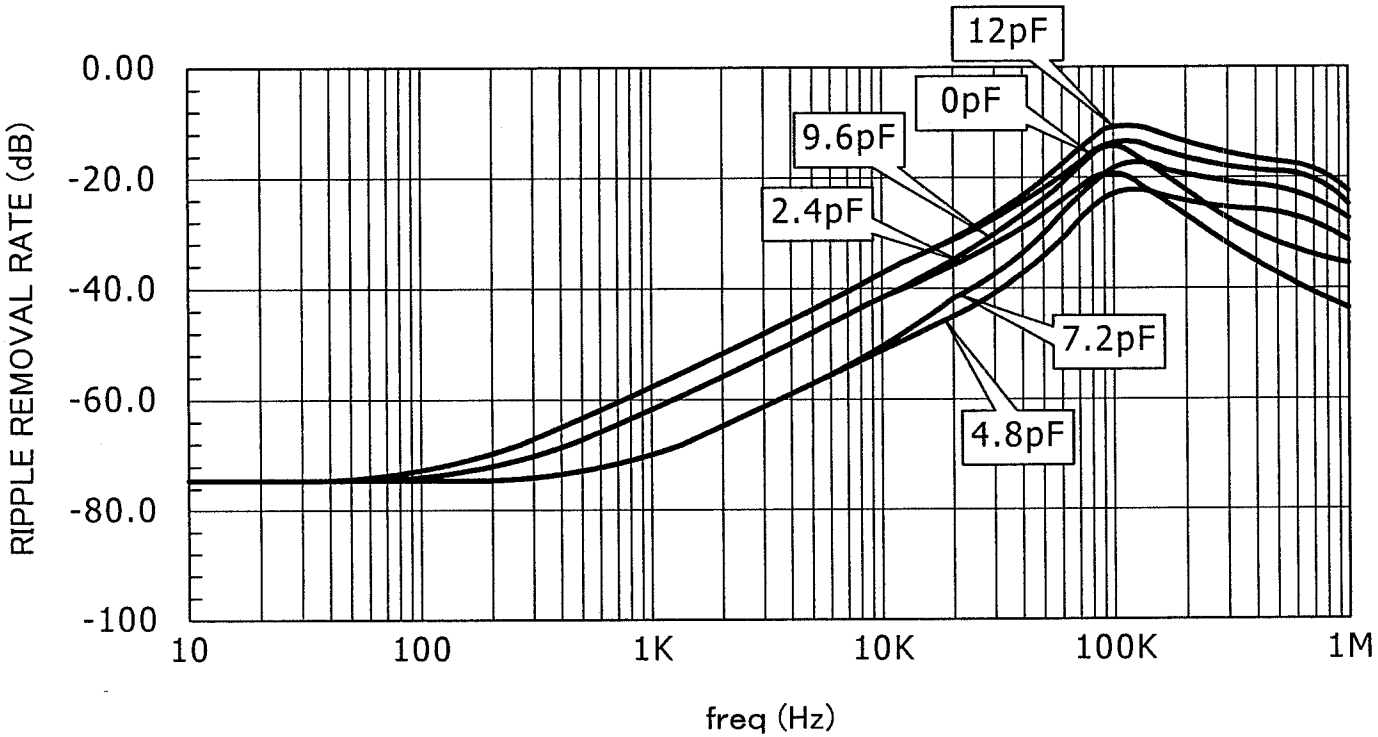
FIG. 2 is a diagram showing a characteristic curve of a ripple removal rate corresponding to each frequency in a preferred embodiment of the present invention.

FIG. 2 is a diagram showing a characteristic curve of the ripple removal rate corresponding to each frequency in the power supply circuit 10. When the capacitance value of the ripple removal rate improving capacitor element 12 is changed among different values, more specifically, 0 pF, 2.4 pF, 4.8 pF, 7.2 pF, 9.6 pF, and 12 pF, as shown in FIG. 2, the best ripple removal rate characteristic can be obtained when the capacitance value of the ripple removal rate improving capacitor element 12 is set at 4.8 pF. Here, because the voltage on the positive electrode side terminal of the ripple removal rate improving capacitor element 12 (that is, the voltage at the connection point between the resistor element 214 and the transistor 216) with respect to the output voltage which is the voltage on the output terminal 90 does not significantly change, even when the ripple removal rate improving capacitor element 12 is provided, the phase characteristic is not significantly affected. Therefore, in the power supply circuit 10, the phase compensation can be executed, and the ripple removal rate can be improved. The above-described capacitance value is merely exemplary, and an optimum ripple removal rate can be obtained with other capacitance values.

Figure 3:
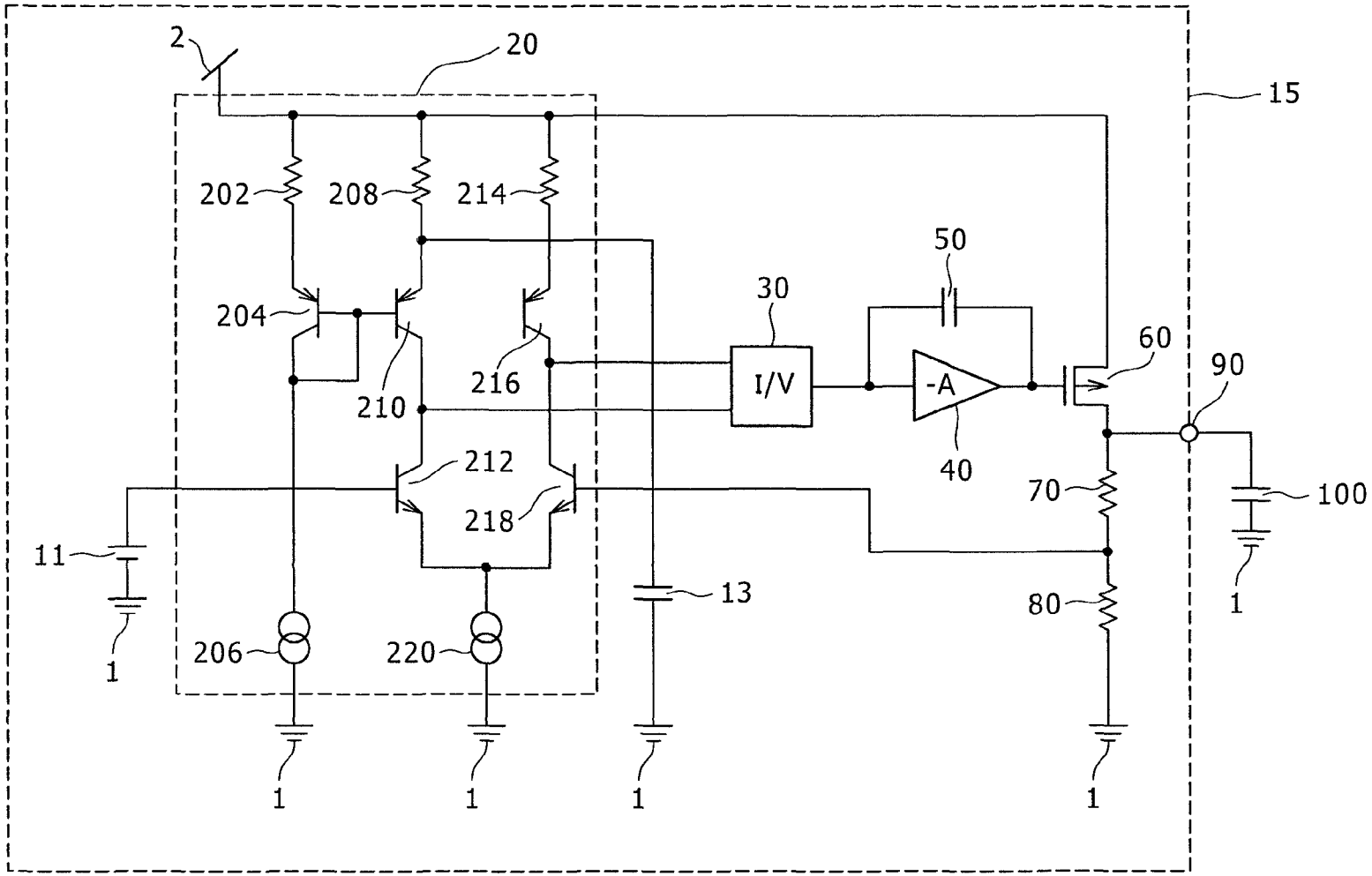
FIG. 3 is a diagram showing an alternative configuration of a power supply circuit in a preferred embodiment of the present invention.

Next, an alternative embodiment of the power supply circuit 10 will be described with reference to FIG. 3. FIG. 3 is a diagram showing a power supply circuit 15 which is an alternative configuration of the power supply circuit 10. As a ripple removal rate improving capacitor element 13 is the only difference between the power supply circuit 15 and the power supply circuit 10, this element will be described in detail.

In the ripple removal rate improving capacitor element 13, a positive electrode side terminal is connected to a connection point between the other terminal of the resistor element 208 and the emitter terminal of the transistor 210, and a negative electrode side terminal is connected to the ground 1 and grounded. Therefore, in the power supply circuit 15, when A1>A2 due to reasons such as variation in the resistance values of the resistor elements 208 and 214, in the path of A1 having a higher AC gain, because the ripple removal rate improving capacitor element 13 is placed between the ground 1 and the connection point between the other terminal of the resistor element 208 and the emitter terminal of the transistor 210, of the two AC gains, A1 is attenuated. With such a configuration, the difference between A1 and A2 can be reduced (that is, the shift in the differential balance is resolved), and the ripple removal rate can be improved. The difference between A1 and A2 can be set to substantially 0 by adjusting the capacitance value of the ripple removal rate improving capacitor element 13. Therefore, with the power supply circuit 15 also, the phase compensation can be executed and the ripple removal rate can be improved.

What is claimed is:

1. A power supply circuit comprising:

a power transistor which is placed between an input power supply and an output terminal;

a differential amplifier which outputs, as a current difference, a difference between a feedback voltage obtained by dividing an output voltage which is a voltage on the output terminal and a reference voltage;

an I/V converter circuit which converts the current difference into a voltage difference; and an amplifier which amplifies the voltage difference and which supplies the amplified voltage difference to a control terminal of the power transistor as a signal for controlling an ON resistance of the power transistor, wherein the differential amplifier comprises:

a first current path in which a first current mirror transistor and a first control transistor are connected in series, wherein the first current mirror transistor is connected to the input power supply, a predetermined current mirror current flows in the first current mirror transistor via a first resistor element, and the reference voltage is input to the first control transistor;

a second current path in which a second current mirror transistor and a second control transistor are connected in series, wherein the second current mirror transistor is connected to the input power supply, a predetermined current mirror current flows in the second current mirror transistor via a second resistor element, and the feedback voltage is input to the second control transistor; and a constant current source section which sets a sum of a current flowing in the first current path and a current flowing in the second current path to be a predetermined constant current, and the power supply circuit further comprises:

a first capacitor element which is connected in parallel with the amplifier; and a second capacitor element to minimize the difference in AC gain between the first and second current paths which is connected either between ground and a connection point between the first resistor element and the first current mirror transistor, or between the ground and a connection point between the second resistor element and the second current mirror transistor.

2. The power supply circuit according to claim 1, wherein the amplifier inverts and amplifies the voltage difference, and the I/V converter circuit converts a current difference when the feedback voltage is higher than the reference voltage into a negative-side voltage difference, and converts a current difference when the feedback voltage is lower than the reference voltage into a positive-side voltage difference.

* * * * *